United States Patent [19]

Richards

[11] Patent Number: 4,458,351

[45] Date of Patent: Jul. 3, 1984

[54] MEMBRANE COOLING SYSTEM FOR METALLURGICAL FURNACE

[76] Inventor: Raymond E. Richards, 36227 Ridge Rd., Willoughby, Ohio 44094

[21] Appl. No.: 247,141

[22] Filed: Apr. 6, 1981

[51] Int. Cl.[3] ..... F27D 1/12

[52] U.S. Cl. ..... 373/76; 432/238

[58] Field of Search ..... 373/71, 74, 75, 76, 373/137, 165, 158; 432/238; 266/241

[56] References Cited

U.S. PATENT DOCUMENTS

| | | | |
|---|---|---|---|
| 3,843,106 | 10/1974 | Nanjyo et al. | 373/76 |
| 4,206,312 | 6/1980 | Kuhlmann | 373/76 |
| 4,207,060 | 6/1980 | Zangs | 373/76 |
| 4,241,232 | 12/1980 | Gelsing | 373/76 |

*Primary Examiner*—Roy N. Envall, Jr.

*Attorney, Agent, or Firm*—Watts, Hoffmann, Fisher & Heinke Co.

[57] ABSTRACT

A membrane cooling system for a metallurgical furnace including a single or series of individual panel sections, each section including a plurality of closely spaced cooling tubes disposed in laterally spaced relation, the tubes being arcuate and/or linear in a lengthwise direction and oriented circumferentially to define exposed inner furnace wall surfaces, spacer bar elements are disposed centrally between and extend between adjacent of the tubes to provide a trough-like recess therebetween, weldments join the spacer bar elements to the cooling tubes to form a continuous, undulating membrane surface, and retention elements are made integral with the membrane surface and extend from the hot face thereby to provide, by refractory or slag build-up, a protective and heat insulation barrier layer of generally uniform thickness to protect the panel sections and to reduce energy losses to the cooling system.

15 Claims, 12 Drawing Figures

MEMBRANE COOLING SYSTEM FOR METALLURGICAL FURNACE

DESCRIPTION

1. Technical Field

The present invention relates to metallurgical apparatus and more particularly relates to a new and improved construction for a cooling panel system of the type for use in metallurgical furnaces, such as electric arc furnaces or the like.

2. Background Art

Metallurgical processes such as electric arc furnaces are in general use for the production of a wide variety of iron and steel from readily available materials. Basically, the electric arc furnace is a melting, holding, or duplexing process that offers flexibility particularly for the production of special steels. In general, the electric furnace consists of a cylindrical casing having a convex base which provides a furnace shell and a convex cover. The casing includes a feed and pouring aperture with the cover being provided with apertures to accomodate the electrodes. Conventionally, the internal walls of the furnace have a more or less thick refractory lining serving to protect the furnace side wall.

Heretofore, it has been found that the conventional side wall construction utilizing metal armoring with a refractory lining is not completely satisfactory in standing up to the high thermal stresses which normally occur in these arc furnaces. Accordingly, the lining has a relatively short life which involves renewal of the lining at considerable expense, as well as reduced production. It has been recognized that water-cooled panels have helped considerably to solve various of the problems, namely, the life and cost of the refractory lining in an arc furnace. It has been found that water-cooled panels permit maintenance of higher power input for a longer period of time. This results in shorter heat times, increased furnace life and increased production. Presently, there are two basic types of water-cooled panels in use. One is the castmetal or solid metal panel or plate type that has cooling water pipes located internally thereof or machined therein. The other water-cooled panel is a fabricated panel commonly referred to as a water box. Typically these water boxes are designed as integral supporting parts of the side walls of the furnace and are generally arranged as segments of a circle which provides a belt-like configuration to form the side wall of the furnace. The water boxes are fabricated with cooling water inlet and outlet openings which enables cooling water to flow through the box along any desired path for cooling purposes. More recently, it has been known to provide the exposed inner surface of the box with a multiple groove or stud configuration to form a refractory or slag build-up that is said to provide for heat insulation and therefore reduction in the energy losses to the cooling water.

For reference to prior types of cooling systems for metallurgical furnaces reference may be had to U.S. Pat. Nos. 2,671,658, 3,314,668, 3,963,223 and 4,206,312.

DISCLOSURE OF INVENTION

The present invention provides a new and improved construction for a cooling lining system for a metallurgical furnace, such as an electrical arc furnace, which comprises a bar-and-tube or undulating membrane cooling panel construction including a single or series of individual cooling panel sections, each of the sections comprising a plurality of cooling tubes disposed in laterally spaced relation, the tubes being arcuate and/or linear in a lengthwise direction and extending horizontally, vertically or angularly so as to define exposed inner furnace wall surfaces, spacer bar means are disposed centrally between adjacent cooling tubes to provide a trough-like cavity to receive a refractory or slag build-up, and weldments join the spacer means bar elements with adjacent of the cooling tubes to provide a substantially continuous undulating membrane construction which is exposed to the furnace melt (hot face) thereby to form a surface to give a relatively heavy build-up of refractory or slag, by adhesion, which provides insulation barrier to reduce energy losses to the cooling water and a protective layer to prolong the furnace life. In a preferred form, the panel sections each include inwardly extending retention elements that coact with the bar-and-tube or membrane construction to enhance build-up of the refractory or slag barrier layer.

In the invention, weldments on both of the panel sides join the bar-and-tube to form homogeneous undulating membrane panel faces. The trough-like cavities formed by the membrane surface construction, with tube radii blending into the welded bar sections, affords basic retention surfaces which are augmented by the "keying" effect of the retention elements which can be quickly and easily factory or field installed.

As employed herein, the term tube includes hollow cylinder or pipe having circular or non-circular (i.e., polygonal) cross-sectional configurations of substantially uniform transverse dimension. Preferably, the tubes have a constant wall thickness to provide a uniform temperature gradient for optimum heat transfer. Also, the cooling lining system of the invention may utilize a single panel section or a series of such panel sections to provide the interior surface wall construction, as desired.

By the bar-and-tube or undulating membrane combination of the invention there is provided a light weight (i.e., compared to cast or machined metal plate panels) yet rugged system which can be made from staple tubing and/or from custom fabricated (formed or rolled) tubing, as desired. The tubing being of constant or uniform wall thickness promotes the refractory or slag adhesion since it will have less tendency to melt-off during the high temperature portion of the melt cycle. For example, by the construction hot and cold spot variations are minimized, as compared to prior cast or mechanical metal plate panels.

By this construction and arrangement, the water-cooled panel sections of the invention help to promote electric furnace operation at higher temperatures and at faster melt cycles for higher outputs. The panel sections extend furnace life and production, assuring many times the heats possible with use of dry refractories. For example, over 85 percent of the dry refractory above the slag line can be replaced by the lighter, water-cooled panel sections of the invention. This substantially lowers load and stress on the surface tilt and lift mechanisms.

The bar-and-tube or undulating membrane construction remains generally leaktight in service because of the elimination of a substantial amount of water chamber welds, as compared to conventional water box designs. The heavy duty membrane construction withstands gouging and damage caused during scrap charging. In addition, the bar-and-tube arrangement with the retention element construction provides the aforesaid initial refractory and ultimate slag build-up, thereby producing extra protection against metal boiling and potential attendant panel spalling. Other further advantages and objects of the invention will become apparent when taken in reference to the following description and drawings in connection with the annexed claims.

BEST MODE FOR CARRYING OUT THE INVENTION

Figure 1:
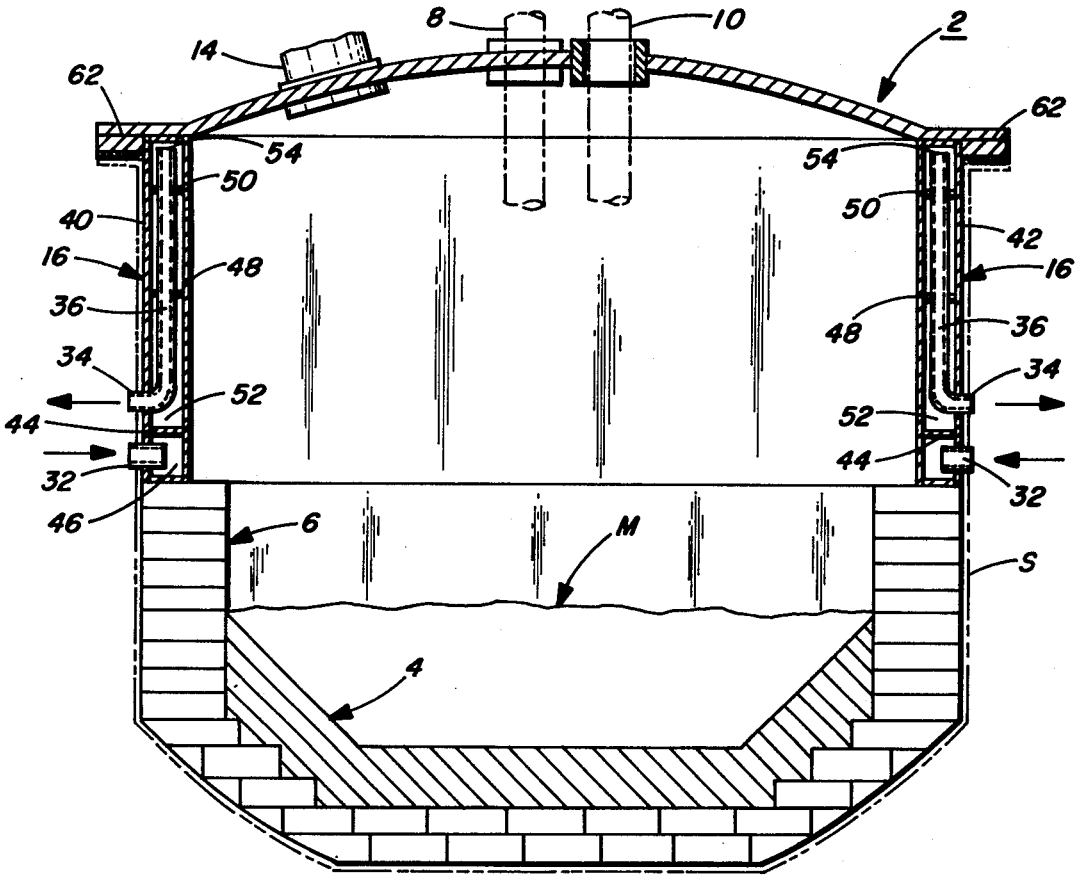
FIG. 1 is a vertical section view through a schematic construction of an electric arc furnace which incorporates the water cooling lining system of the invention.

Referring again now to the drawings and in particular to FIG. 1 thereof, there is illustrated a conventional type electric arc furnace, designated generally at 2, and of the type of which the present invention may be employed. It is to be understood, however, the invention may be employed with other types of metallurgical furnaces or apparatus, such as in open hearth furnaces as in the lintel and door areas, for example. As shown, the furnace 2 includes a convex base 6 having a refractory bottom lining 4 inside a metal shell S. Electrodes 8 and 10 extend through the top of the furnace together with a gas discharge pipe 14, as known in the art. Accordingly, the present invention provides a water-cooled membrane system, designated generally at 16, which provides a surface that gives a protective, insulation barrier layer, in the form of a refractory and slag build-up, to reduce energy losses to the cooling water resulting from the high thermal temperatures of the melt.

Now in accordance with one form of the invention, the cooling system may include a series, such as six, individual panel sections (FIG. 3) 17 mounted above the slag line within the furnace shell S to provide a cylindrical configuration so as to accomodate the curvature of the furnace shell. In the embodiment illustrated, each panel section 17 includes a plurality of elongated, hollow tubes 18 which are spaced laterally from one another and which extend horizontally or at right angles to the vertical central axis of the furnace. Accordingly, the tubes 18 are formed with the required curvature to provide an arcuate configuration to give the ultimate cylindrical configuration desired. It will be understood, however, that the tubes 18 can be linear, as in the case of larger diameter furnaces, rather than being curved, shown. Also, it will be recognized that the tubes can extend vertically or parallel to the vertical central axis of the furnace, as desired.

Figure 5:
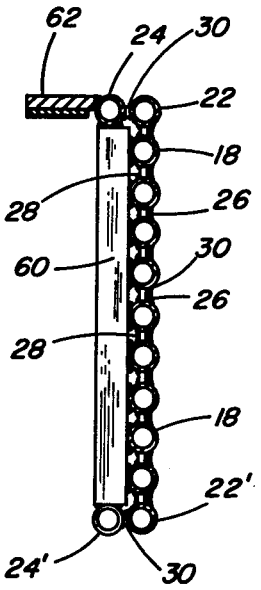
FIG. 5 is a fragmentary section view taken along line 5—5 of FIG. 3.

As best seen in FIG. 5, the individual tubes 18 are fixedly attached to one another by individual spacer means in the form of bar elements 26 which extend centrally therebetween. The spacer bar elements 26, therefore, lie in a common plane which contains the longitudinal central axis of the respective tubes 18 so as to provide a trough-like cavity or recess between adjacent pipes. In the invention, the spacer bar elements 26 are fixedly secured to the adjacent tubes 18 by weldments, as at 30, which partially fill the trough-like cavity or recess between adjacent tubes. By this construction and arrangement, there is provided a continuous, undulating membrane surface which is exposed to the furnace melt (hot face) to provide for a build-up of refractory and slag. This build-up creates, in effect, a refractory insulation barrier layer which provides a surface that gives a protective and heat barrier against energy losses caused by the cooling water circulated through the tubes 18. The opposite sides of the spacer bar elements 26 may be provided with additional weldments, as at 28, to enhance the strength characteristics of the membrane panel. In the invention, the retention means may be separate bars, rods or the like or may include tubes with integral bar-like flanges that could be welded together.

Figure 3:
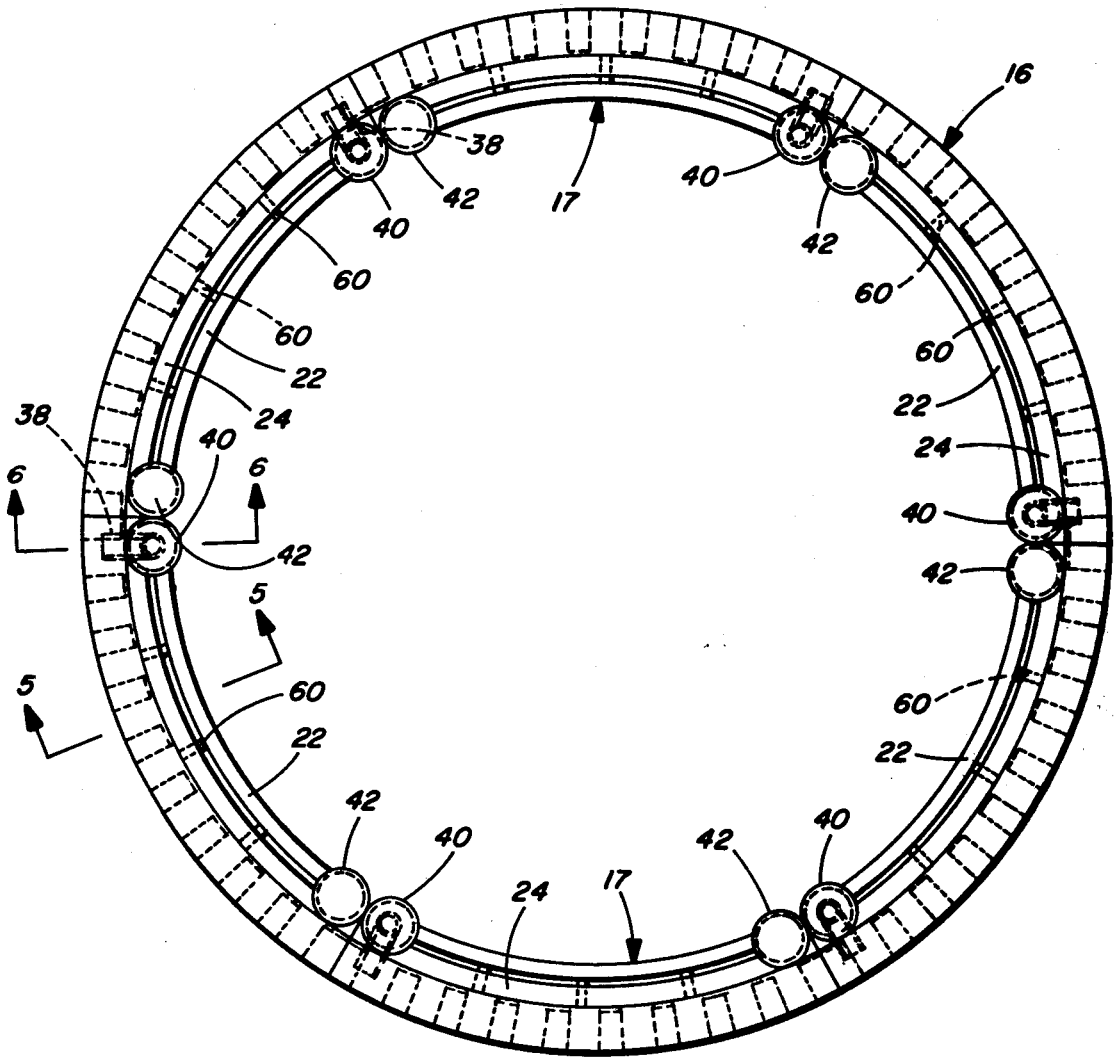
FIG. 3 is a top elevation view schematically illustrating a series of the individual panel sections circumferentially mounted to define an interior furnace side wall in accordance with the invention.
Figure 4:
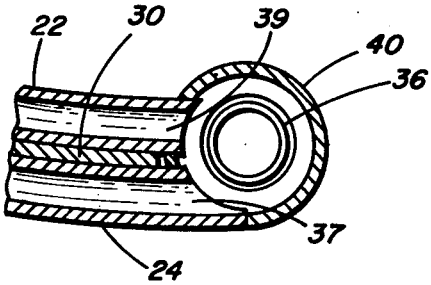
FIG. 4 is a fragmentary section view taken along line 4—4 of FIG. 2.

As best seen in FIGS. 3, 4 and 5, each panel section is provided with an upper cooling tube 22 (hot face) disposed in vertical alignment with the inner tubes 18 and a laterally outwardly by disposed tube (cold face) 24 which are integrally joined together by weldments, as at 30, to provide a dual tube construction at the top of the panel section. Also, the panel section may be provided with a similar lower 22' and outer 24' dual tube construction at the lower end of the panel section. To further enhance the strength characteristics of the individual panels, vertically extending support plates, as at 60, may be fixedly attached, as by weldments, to the corresponding rear surfaces of associated of the cooling tubes 18, 24 and 24. A top plate 62 may be welded to the upper inner tube 24 and to the header tubes 40 and 42 to provide a support flange for mounting on the furnace shell S, as seen in FIG. 1. By such arrangement, structural support is given to the cooling tubes in the event of impact forces from the hot face side.

Figure 2:
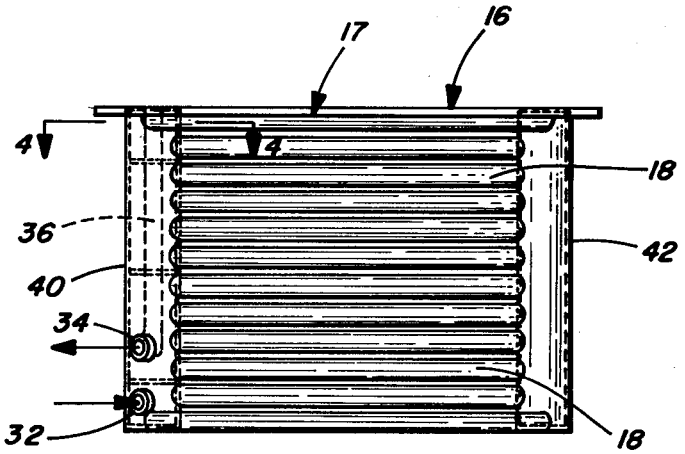
FIG. 2 is a front (cold side) elevation view of an individual panel section on a reduced scale made in accordance with the invention.
Figure 6:
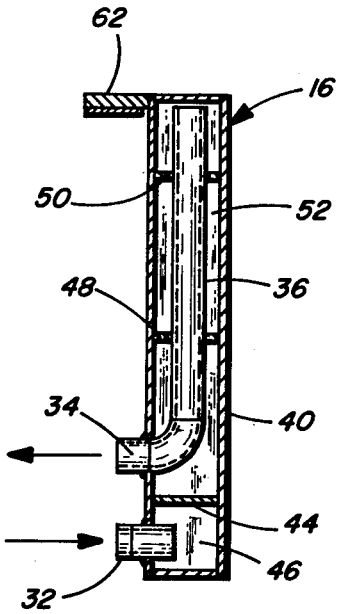
FIG. 6 is a fragmentary section view taken along line 6—6 of FIG. 3.

Now in accordance with the invention, the panel sections 17 are provided with a pair of vertically extending header members 40 and 42 for circulating the flow of cooling water from a supply source (not shown) through the tubing system for discharge. For this purpose, each panel section may be provided with a cooling water inlet 32 (FIG. 2) and an outlet 34 which includes an outlet pipe 36 disposed within the header member 40. The header member 40 communicates the inlet 32 via a chamber 46 (FIG. 1) with the cooling tubes 18. The header 40 connects the outlet 34 of the outlet pipe 36 via a chamber 52 with the cooling tubes for discharge of the cooling fluid. Suitable baffle plate members (FIG. 6) 48 and 50 may be disposed within the chamber of the header member receive the outlet pipe 36 therethrough.

Accordingly, the chambers may be separated by baffle plates 44, 48 and 50 hich separate the chambers from one another and hence, the inlet and outlet from one another. As will best be seen in FIG. 4, the cooling tubes 22 and 24, for example, include internal passageways 37 and 39 which extend through corresponding apertures provided in the header member 40 for circulating cooling water flow through the tubes in any predetermined path between the headers 40 and 42.

In the invention, it will be recognized that the interior configuration of the cooling pipes may be constructed and arranged so as to provide any desired path for the coolant. For example, the coolant may follow any flow (i.e., single linear line, serpentine or the like) path with the pipe lengths being disposed horizontally, vertically or at an angle.

While a specific embodiment of the invention has been shown and described in detail to illustrate the application of the principals of the invention, it will be understood that the invention may be embodied otherwise without departing from such principals, as will be seen in reference to following FIGS. 7–12 of the drawings, for example.

Figure 7:
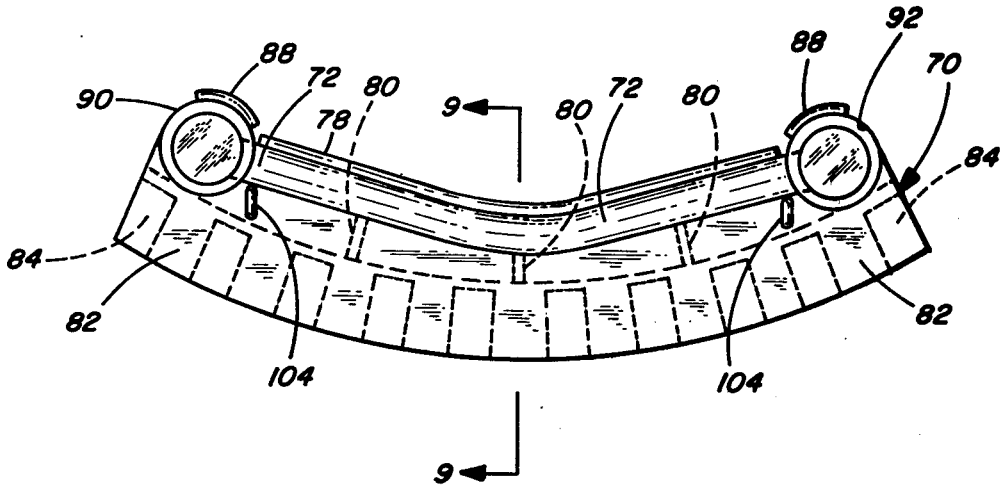
FIG. 7 is a top plan view of a modification of a panel section made in accordance with the invention.
Figure 8:
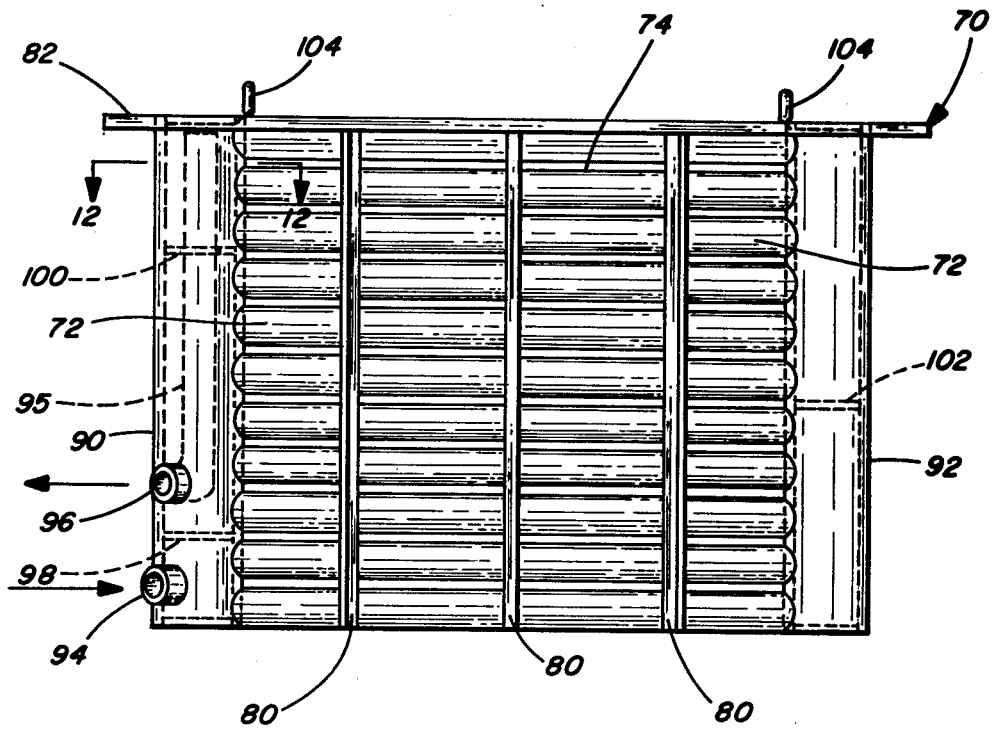
FIG. 8 is a front elevation view of the panel section of FIG. 7.
Figure 9:
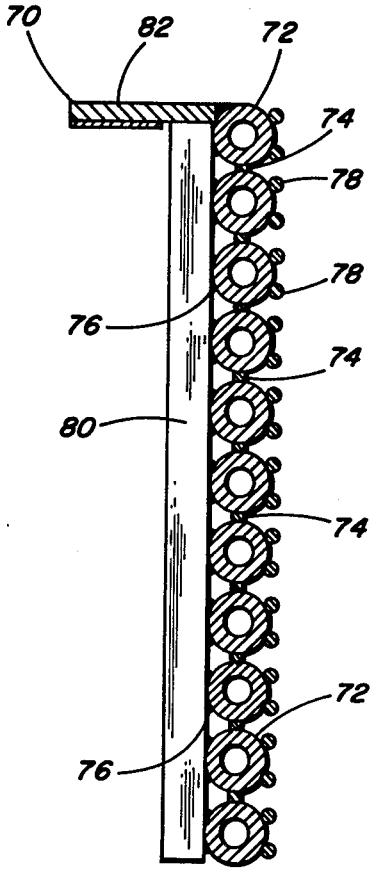
FIG. 9 is a vertical section view of the panel section of FIG. 7.

Referring now to FIGS. 7, 8 and 9, there is illustrated a modification of the panel section, designated generally at 70, made in accordance with the present invention. In the embodiment shown, the panel section 70 includes a plurality of vertically spaced tubes 72 which are laterally spaced by spacer bar elements 74. The tubes 72 are welded, as at 76, to a series of vertically extending support members 80 which abutt against the interior surface of the furnace wall to protect against hot face impact faces or the like, as aforesaid. Here again, the spacer bar elements 74 extend in the general medial plane which contains the longitudinal axis of the tubes 72 and are welded to the tubes so as to provide a trough-like cavity or recess therebetween.

In the embodiment illustrated, the tubes 72 are provided with horizontally extending retainer elements 78 in the form of solid metal bar elements which are welded to the outer confronting surface of the respective tubes. These retainer elements 78 provide an irregular exposed surface area to give a "key" effect so as to enhance build-up of a refractory and slag layer on the continuous, undulating membrane surface provided by the associated tubes 72 and spacer bar elements 74. In the invention, it will be appreciated that the retainer elements can be of a hollow or solid construction and of any cross-sectional shape, as desired.

As best illustrated in FIG. 7, the tubes 72, bar elements 74 and retainer elements, 78 are bent (i.e., fabricated or rolled) generally at the midpoint thereof so as to provide a non-linear configuration. By this arrangement, the panel section provides a membrane surface which is not just curved nor linear but which incorporates a dual curved and linear construction so as to define the interior side wall surface of the furnace. It will be understood, therefore, that the respective panel sections can be provided with curved, linear or a composite configurations thereof. Also, it will be seen that in the invention that the panel tubes could be disposed at various angles in respect to one another to accommodate metallurgical furnace applications (i.e., inclined or shaped side walls) requiring conical or trapezoidal shaped panel sections, for example.

Figure 10:
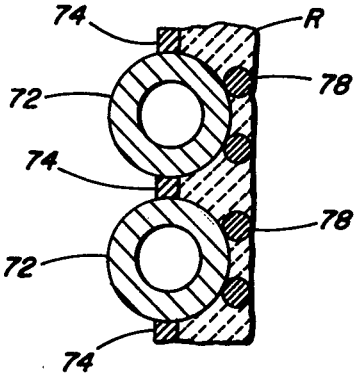
FIG. 10 is a fragmentary vertical section view, on an elongated scale, illustrating utilization of the retainer elements for maintaining a refractory build-up.

As best illustrated in FIG. 10, the retainer elements 78 coact with the tubes 72 and spacer bar elements 74 to enable the user to apply a refractory layer, as at R, to the undulating membrane surface. Accordingly, the present invention provides a construction which provides either a natural build-up of refractory and slag or which enables the user to build-up such layer, as desired.

In the embodiment illustrated, the panel section 70 includes header members 90, 92 which are of a hollow tube (formed or rolled) construction. Accordingly, the tubes 72 communicate at their opposed ends with the header members 90, 92 (FIG. 12) such that cooling fluid can be introduced through the inlet, at 94, so as to travel a predetermined path through the tubes and out through the outlet tube 95, as described in connection with the cooling fluid flow of FIG. 6. Accordingly, in this embodiment cooling fluid may enter the inlet 94 and traverse the tubes 72 into the header member 92 and then back through tubes 72 into header member 90 and so on until the cooling fluid enters the top of the outlet tube 95 in the header member 90 so as to be discharged through the outlet 96. Here again, it will be understood that the cooling fluid flow may take any path through the panel section dependent upon the construction and design of the tube configuration, as desired.

Figure 12:
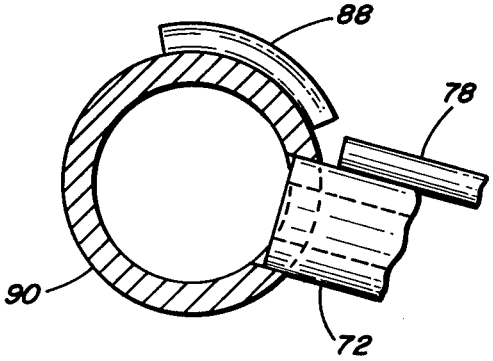
FIG. 12 is a horizontal section view, on an enlarged scale, taken along the line 12—12 of FIG. 8.

As best illustrated in FIG. 12, the respective header members 90, 92 may each be provided with curved retainer elements 88 in the form of solid bars which are vertically spaced so as to coincide in alignment and number with the retainer elements 78 on the tubes 72. By this arrangement, the header members are also protected and coact with the tubes 72 so as to provide a substantially continuous refractory and slag build-up on the membrane surface to optimize the protective and insulation characteristics of the panel sections against energy loss to the cooling system.

Figure 11:
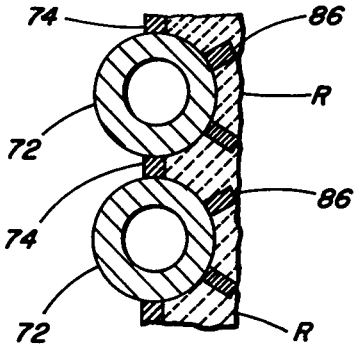
FIG. 11 is a fragmentary vertical section view, on an enlarged scale, illustrating utilization of a modified form of the retainer elements made in accordance with the invention.

In FIG. 11 there is illustrated a further modification of the present invention wherein the tubes 72 are provided with retainer elements 86 which are of a stud-like construction welded at an angle to the respective tubes 72. Accordingly, the retainer elements 86 preferably extend divergently outwardly from the associated tubes 72 and may be of a polygonal configuration in transverse cross-section. Here again, this retainer arrangement facilitates the build-up of a refractory and/or slag layer, as at R, either by natural build-up or by an external build-up, as aforesaid.

As best illustrated in FIGS. 8 and 9, a top plate member 82 may be mounted, as with plate 62, which provides a supporting flange for mounting on the outer furnace shell. In the invention, it is contemplated that the individual panel sections and/or a series of such sections may be detachably mounted interiorly of the furnace shell by various systems such as bolts, wedge block or the like.

Accordingly, while four forms of the invention have been illustrated for purposes of example, it will be understood that other forms and modifications are contemplated and possible within the scope of the present invention as determined by the scope of the following claims.

I claim:

1. A metallurgical furnace, such as an electrical arc furnace, of the type having a water cooling system, the improvement comprising a membrane cooling panel construction made from a plurality of individual cooling panel sections, said panel sections being disposed in end-to-end relationship and oriented circumferentially to define an innner exposed hot wall surface, each panel section comprising a plurality of generally cylindrical cooling tubes disposed in substantially parallel, juxtaposed relation and being spaced laterally apart a distance sufficient to define a lateral spacement area therebetween, said cooling tubes being oriented circumferentially to define said hot wall surface, spacer bar means disposed in generally centered relation in the spacement area between adjacent of said cooling tubes, said spacer bar means having a widthwise dimension sufficient to provide a trough-like recess therebetween, said spacer bar means acting to hold the individual cooling tubes out of contacting relationship with one another, weldments joining the associated spacer bar means with the adjacent surfaces of the respective cooling tubes to provide a substantially continuous, undulating membrane surface exposed to the furnace melt, and a source of cooling fluid for delivering a cooling fluid to said cooling tubes.

2. A metallurgical furnace in accordance with claim 1, including retainer elements affixed to and extending outwardly from said cooling tubes, said retainer elements including elongated elements welded to the outer confronting surfaces of the respective cooling tubes and extending longitudinally thereof, said retainer elements being disposed close to the surface of the cooling tubes and adapted to retain slag or the like to form a refractory build-up on said membrane surface

3. In a metallurgical furnace in accordance with claim 1, wherein said cooling tubes and spacer bar means are arcuate, and said spacer bar means lie in the general medial plane which extends through the central axis of adjacent said cooling tubes.

4. In a metallurgical furnace in accordance with claim 1, wherein said cooling tubes and spacer bar means are linear, and said spacer bar means lie in the general medial plane which extends through the central axis of adjacent said cooling tubes.

5. In a metallurgical furnace in accordance with claim 1, wherein said cooling tubes are disposed in juxtaposed parallel relation and extend in a horizontal direction and generally normal to the central vertical axis of said furnace.

6. In a metallurgical furnace in accordance with claim 1, wherein said cooling tubes are disposed in side-by-side vertical relation and extend in a vertical direction and generally parallel to the central vertical axis of said furnace.

7. In a metallurgical furnace in accordance with claim 1, wherein said cooling tubes are disposed at an angle with respect to one another and to the central vertical axis of said furnace.

8. In a metallurgical furnace in accordance with claim 1, wherein each panel section is substantially linear and is bent adjacent its midpoint.

9. In a metallurgical furnace in accordance with claim 1, wherein the individual cooling tubes and spacer bar means of each section are symmetrically curved in a circumferential direction.

10. In a metallurgical furnace in accordance with claim 1, wherein said cooling tubes communicate with header members, and said header members communicate with inlet and outlet means for transmitting cooling fluid through said cooling tubes.

11. In a metallurgical furnace in accordance with claim 10, wherein spaced support plates are affixed to the cold face of said cooling tubes to provide lateral support therefore.

12. In a metallurgical furnace in accordance claim 1, including retainer elements affixed to and extending outwardly from said cooling tubes in a direction away from the furnace hot face.

13. In a metallurgical furnace in accordance with claim 12, wherein said retainer elements comprise solid bar elements affixed to and extending parallel to said cooling tubes.

14. In a metallurgical furnace in accordance with claim 12, wherein said retainer elements comprise axially spaced, oppositely disposed pairs of angularly outwardly extending stud-like elements.

15. In a metallurgical furnace in accordance with claim 12, wherein said retainer elements are selected from the group consisting of circular and non-circular polygonal cross-sectional shapes.

* * * * *